United States Patent [19]

Höglund et al.

[11] 4,356,213

[45] Oct. 26, 1982

[54] CHIP TREATMENT

[75] Inventors: Hans E. Höglund, Matfors; Per V. Peterson, Sundsvall, both of Sweden

[73] Assignee: SCA Development Aktiebolag, Sweden

[21] Appl. No.: 236,788

[22] Filed: Feb. 23, 1981

[30] Foreign Application Priority Data

Mar. 14, 1980 [SE] Sweden ..... 8002015

[51] Int. Cl.[3] ..... B05D 1/18; B05D 3/04

[52] U.S. Cl. ..... 427/212; 162/17; 162/19; 162/60; 162/68

[58] Field of Search ..... 427/212; 162/17, 19, 162/60, 68

[56] References Cited

U.S. PATENT DOCUMENTS 3,558,428 1/1971 Apslund ..... 162/19

*Primary Examiner*—James R. Hoffman

*Attorney, Agent, or Firm*—Lerner, David, Littenberg & Littenberg

[57] ABSTRACT

A treatment for wood chips in the manufacture of pulp is described. Prior to chip washing, the chips are placed in contact with an impregnation liquid such that all readily fillable cavities in the chips become filled with the liquid. The chips can be steamed prior to the impregnation process to increase the liquid absorption. After the impregnated chips are drained of the excess liquid, no appreciable amount of washing liquid is absorbed by them during a subsequent washing cycle used to remove included gravel and sand.

8 Claims, 4 Drawing Figures

CHIP TREATMENT

BACKGROUND OF THE INVENTION

The present invention relates in general to the treatment of wood chips for manufacturing pulp in a pulp mill, and more particularly, to the manufacture of pulp by subjecting the wood chips to a chemical treatment, such as chemi-mechanical, semi-chemical or chemical pulp.

The manufacture of pulp from wood chips by chemi-mechanical and semi-chemical treatment requires a final mechanical defibration of the wood chips in special equipment. Pulp produced by chemical treatment alone normally does not require any special mechanical defibration subsequent to its efficient digestion. Today, pulp mills generally receive included with the supply of wood chips, great amounts of gravel and sand. This often creates great difficulty in processing the wood chips especially in defibration equipment of the refiner type or the like and in many other places in the pulp mill. In the manufacture of mechanical pulp using defibration equipment of the refiner type, the wood chips are usually washed in water to remove the gravel and sand in a wood chip washer of which several designs exist. Characteristic of the operation of these chip washers is that the wood chips take up relatively great amounts of liquid by absorption. This liquid absorption has not been found to be a direct disadvantage in the manufacture of purely mechanical pulps. However, such liquid absorption does present a significant disadvantage in terms of the heat and other technical requirements when used in connection with a subsequent chemical impregnation and heat treatment/digestion of the wood chips. For this reason, washing of the wood chips in water is normally avoided as soon as a more complicated chemical treatment of the wood chips is required, as is the case of chemi-mechanical, semi-chemical, and chemical pulps. Wood chip washing with a cooking liquor is used in some cases, but this implies limitations from an apparatus view because special attention must be paid to the chemicals used in the cooking liquor.

Accordingly, there is an unsolved need for a wood chip treatment process to solve the aforementioned problems associated with the manufacture of pulp.

SUMMARY OF THE INVENTION

It is broadly an object of the present invention to provide a chip treatment which overcomes or avoids one or more of the foregoing disadvantages associated with the prior art process used in the manufacture of pulp. Specifically, it is within the comtemplation of the present invention to provide a chip treatment process which prevents the chips from absorbing water during a washing cycle used to removed included material.

In accordance with one illustrative embodiment of the present invention, there is provided a method of treating wood chips in the manufacture of pulp. The wood chips are impregnated with an impregnation liquid, for instance NaOH, $NaHSO_3$ or $Na_2SO_3$, which causes the cavities within the wood chips to become filled with the impregnation liquid. The wood chips are drained to remove the excess impregnation liquid from the chip cavities. The impregnated chips are then washed with a wash solution whereby the wood chips are prevented from absorbing the wash solution by the presence of impregnation liquid remaining within the wood chips.

BRIEF DESCRIPTION OF THE DRAWINGS

The above description as well as further objects, features and advantages of the present invention will be more fully understood by reference to the following detailed description of a presently preferred, but nonetheless illustrative, chip treatment method when taken in conjunction with the accompanying drawings, wherein.

DETAILED DESCRIPTION

The present invention solves the aforementioned problems by impregnation of the wood chips with an impregnation liquid at atmospheric or elevated pressure. The impregnation liquid fills all easily accessible cavities in the chips. By a subsequent complete free drainage of the chips, it is possible to carry out a normal chip washing cycle in water without appreciable amounts of water being absorbed by the chips nor any substantial diffusion of impregnation liquid out of the chips and into the washing liquid. The chip washing time is generally short and the washing is preferably carried out at atmospheric pressure. After washing, the chips if desired can be impregnated further in a more rigorous impregnation operation whereafter they are ready for the next processing step. The cavities found in sapwood are easily filled with the impregnation liquid and is generally desirable before chip washing. As certain heartwoods have cavities having difficult access thereto, these chips therefore do not need filling with the impregnation liquid before chip washing. However, filling may be required before a more exacting digesting process.

In accordance with the present invention, the liquid absorption for spruce chips was studied in a first experiment at three different temperatures after a short, i.e., two minute, and a relatively long, i.e., thirty minute, impregnation time. The liquid absorption of unsteamed and steamed chips was measured. The steaming was carried out for a very short and a relatively long period of time. The change in dry content of the chips after these impregnations is shown in FIG. 1.

Figure 1:
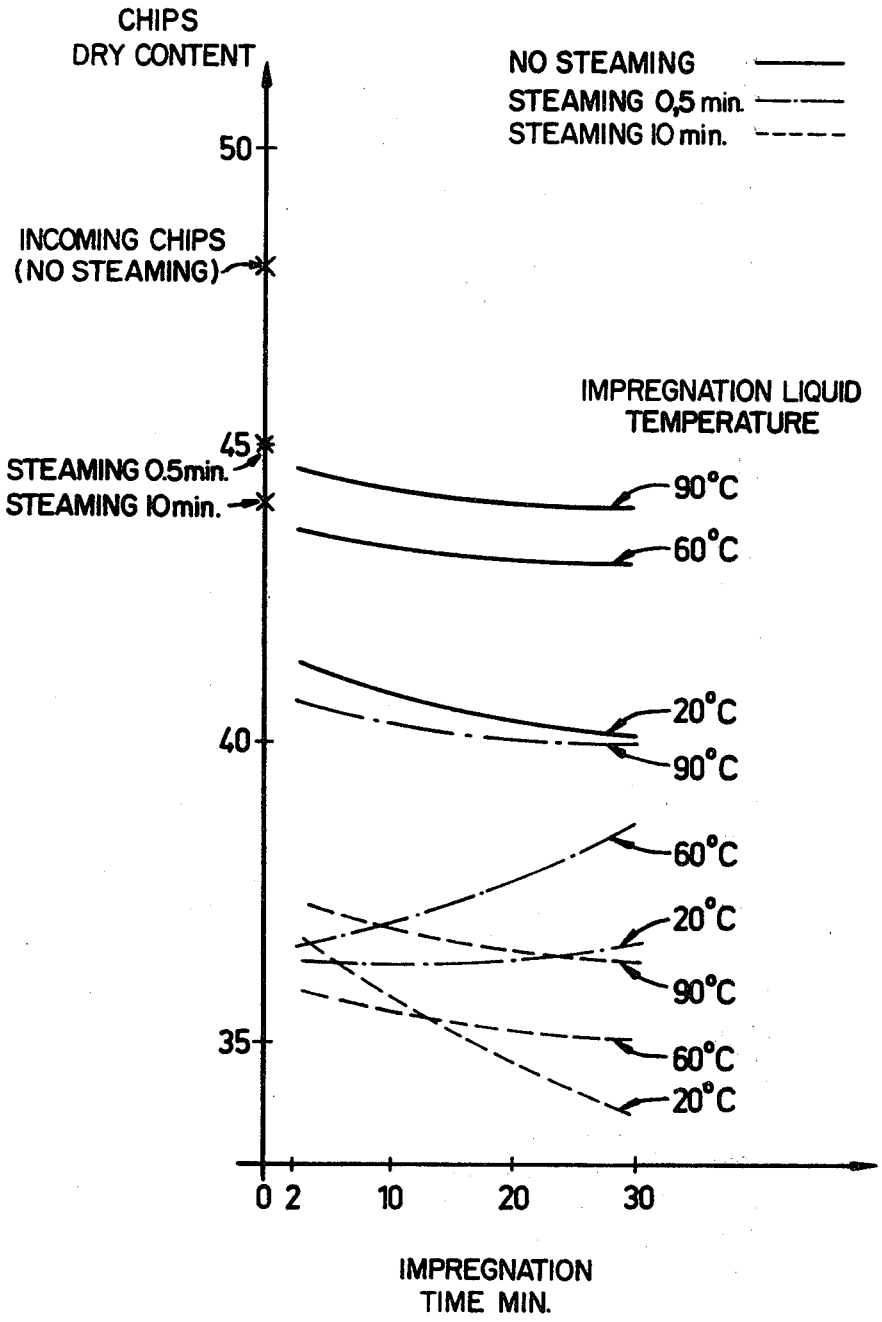
FIG. 1 shows the dry content of spruce chips as a function of the steaming time, impregnation time and impregnation temperature.

As shown in FIG. 1, the impregnation time is the least significant variable of the three variables examined in the experiment interval studied. Sufficient steaming combined with low temperature of the impregnation liquid yields the greatest liquid absorption.

During the steaming operation, air is driven out from the lumen of the fibres of the chips with water vapor replacing the air. When the steamed chips are cooled by an impregnation liquid having a temperature lower than that of the chips, the gas volume within the chips decreases. Impregnation liquid is sucked into the chips by the vacuum thus created. The greater the temperature difference between the steamed chips and the impregnation liquid, the greater the liquid absorption by the chips.

FIG. 1 also shows that short steaming and impregnation times likewise yield good liquid absorption. A second experiment was conducted to study this effect more closely and to generate measuring points in a shorter time interval than that of the first experiment. In this second experiment, four different steaming times shorter than ten minutes at a constant impregnation time of two minutes were tested. Also, four short impregnation times, i.e., ≦two minutes, after two minutes of steaming were tested.

Figure 2:
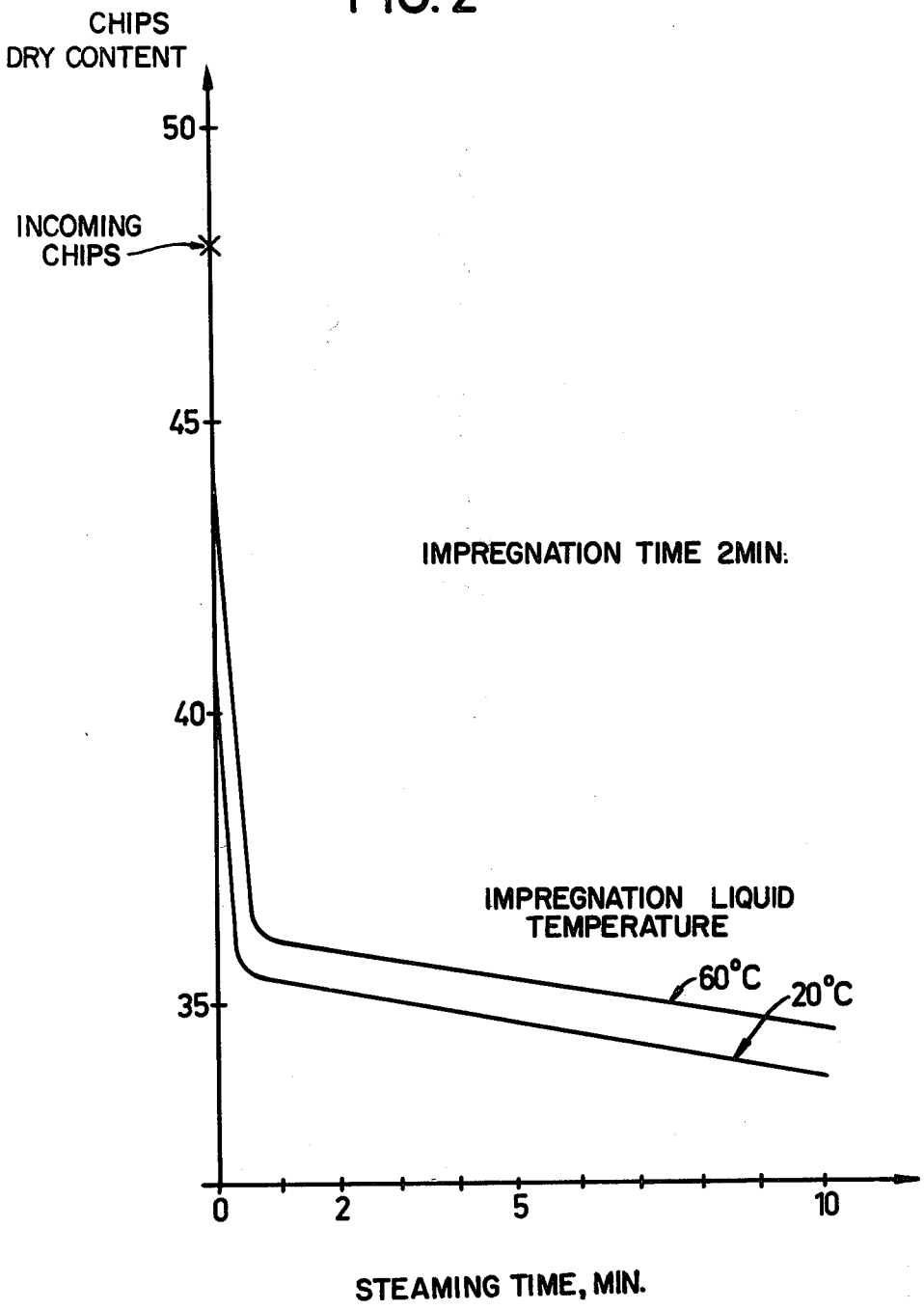
FIG. 2 shows the change in dry content of spruce chips after impregnation as a function of the preceding steaming time.
Figure 3:
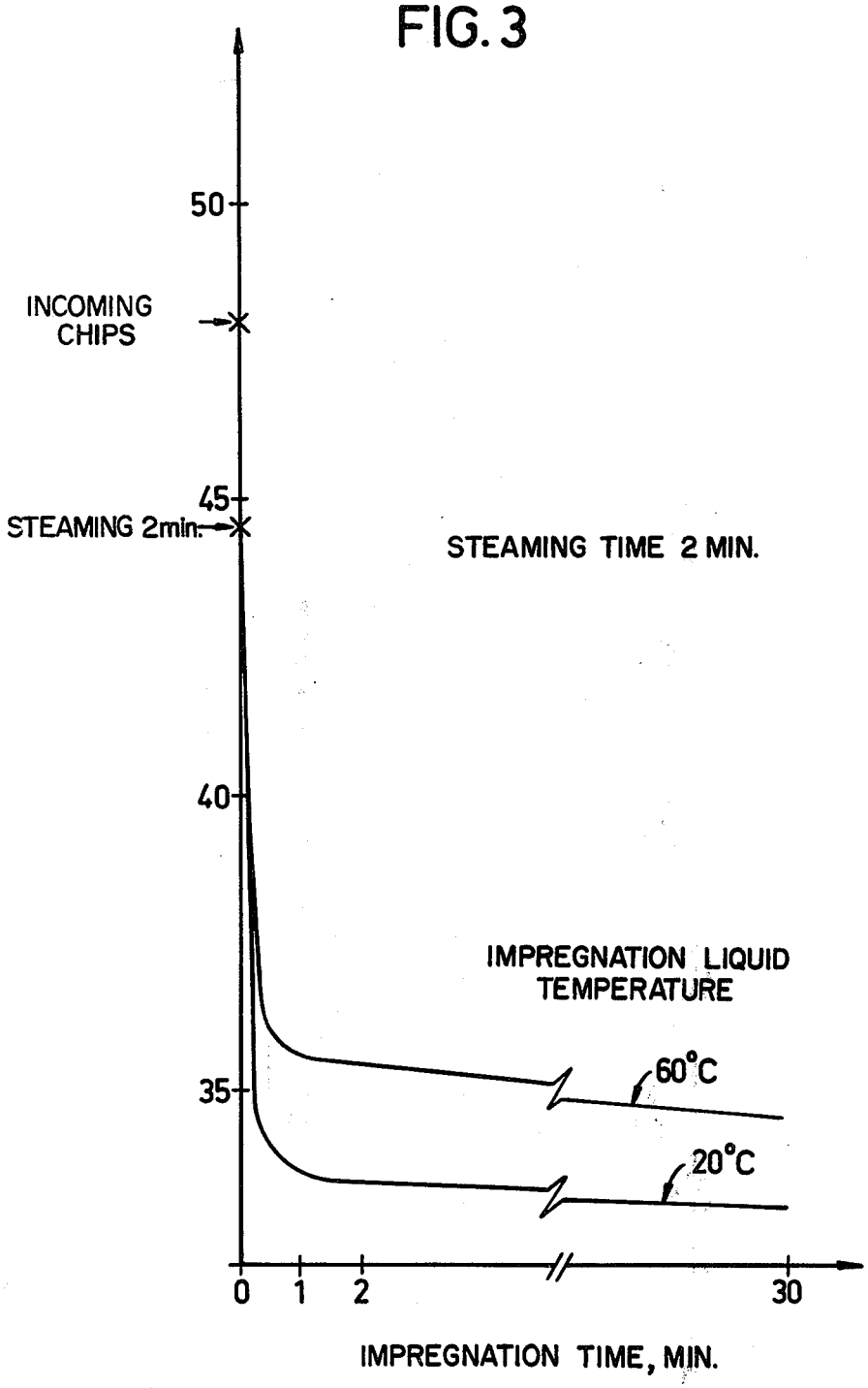
FIG. 3 shows the dry content of steamed spruce chips as a function of very short impregnation times.

The results of the second experiment are shown in FIGS. 2 and 3. FIG. 2 shows that the dry content of the chips drops approximately linear with the steaming time within the time interval studied. The differences in absorbed liquid increase with the different steaming times, however, these differences are relatively small and depend to a large extent on the decrease in the dry content of the chips during the steaming operation. This distinctive difference is found between the test points with unsteamed and steamed chips. From the second experiment, it can be concluded that the steaming time plays a small, possibly insignificant, role in the liquid absorption process when the chips have assumed the desired steaming temperature.

FIG. 3 shows that the liquid absorption rate of steamed chips is very rapid. The difference in dry content of the chips after impregnation for fifteen seconds and thirty minutes is relatively small. This result can be duplicated with the use of impregnation vessels of all types, provided that the chips are sufficiently steamed and the temperature of the impregnation liquid is not too high.

The results described herein show that liquid absorption initially proceeds very rapidly. After about one minute of impregnation time, all easily accessible cavities in the chips are filled with impregnation liquid, and subsequent liquid absorption proceeds very slowly. When the retention time in the chip washer is short, i.e., a maximum of two minutes and suitably shorter than one minute and preferably shorter than thirty seconds, the liquid absorption by the chips during the pulp manufacturing process is insignificant, provided that the chip washing is preceded by an impregnation step with an impregnation time exceeding about one minute.

Figure 4:
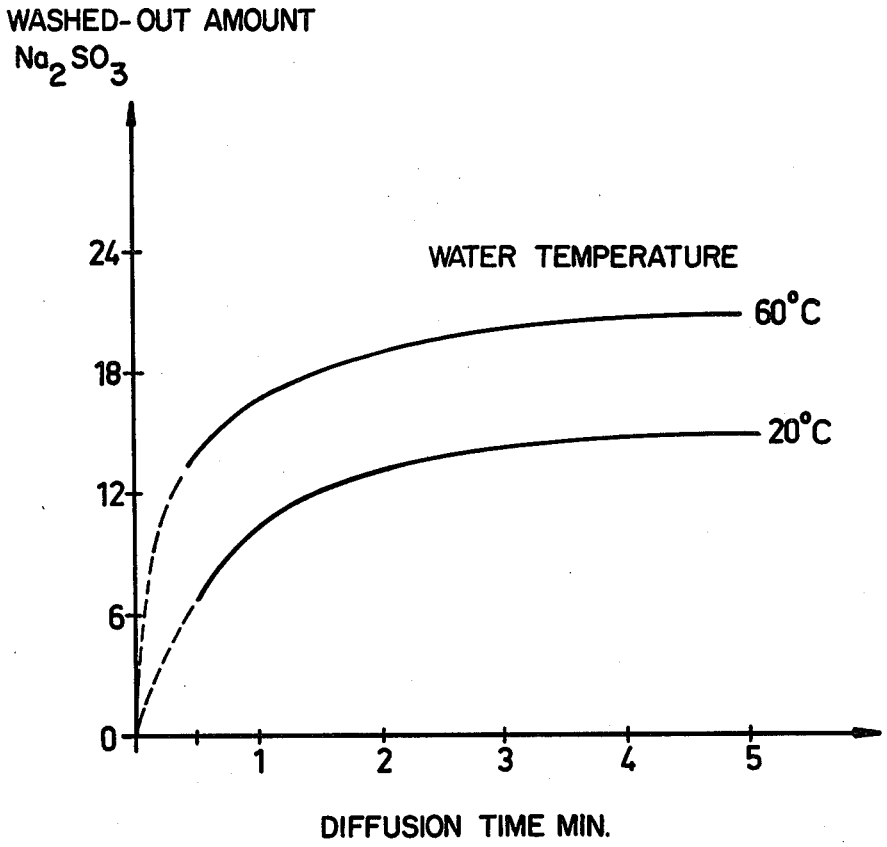
FIG. 4 shows the diffusion time from out of the spruce chips of the impregnated liquid as a function of the quantity of water washing and its temperature.

FIG. 4 shows the result obtained from an experiment where spruce chips were impregnated with 61 kg $Na_2SO_3$ per ton of chips. The results show the quantity of $Na_2SO_3$ that diffuses out of the chips when the impregnated chips are immersed in clean water at 20° C. and 60° C. over a time interval of 0.5 to 5 minutes.

When the chip treatment of the present invention is incorporated in a process with a short preheating or digesting time, for example in a process for manufacturing chemically modified thermo-mechanical pulp, so-called CTMP, only part of the impregnated liquid actively affects the fiber wall of the chips. This is believed to occur because the chemical solution in the chip cavities has insufficient time to diffuse into the fiber walls of the chips.

A process for the manufacture of CTMP, based for example on pretreatment with a chemical solution of $Na_2SO_3$, can advantageously be carried out in accordance with the present invention as follows. This process is initiated by steaming incoming chips, at atmospheric pressure up to between 90° and 100° C. followed by subsequent liquid impregnation at a temperature below 60° C. for about one minute and then washing for less than 30 seconds. Thereafter the process of preheating and refining are performed.

Of the impregnated liquid, only the part diffusing into the fiber wall of the chips is active. By placing the impregnation step early in the pulp manufacturing process, a long time is provided for diffusion of the impregnation liquid into the fiber wall. The chemical solution, having insufficient time for affecting the fiber wall of the chips during their transport to the refiner, usually is regarded as a process loss. At a subsequent bleaching operation, for example, it may be considered advantageous that the excess impregnation chemicals be removed because they normally consume bleaching chemicals. It may also be considered advantageous that the chemicals, which during the impregnation step have not diffused into the fiber walls of the chips, be removed by washing the chips.

When the chip washer is arranged for use after the impregnation, part of the impregnation chemicals is transferred from the chips to the washing liquid. The staying time in the chip washer being short, most of the chemicals transferred come from surface water on the chips or from lumen liquid at the ends of the chips. According to laboratory investigations, about 15 percent of the sulphite is transferred while washing in clean water at the temperature and time occurring in a chip washer (see FIG. 4). The greatest part can be considered excess chemicals. When the impregnation washing system approaches equilibrium, the chemical content in the washing liquid contributes to a decrease of the content washed out.

Although the invention herein has been described with reference to particular embodiments, it is to be understood that these embodiments are merely illustrative of the principles and application of the present invention. Thus, it is to be understood that numerous modifications may be made in the illustrative embodiments and other arrangements may be devised without departing from the spirit and scope of the present invention as defined by the appended claims.

What is claimed is:

1. A method of treating wood chips in the manufacture of pulp therefrom, comprising the steps of, impregnating said wood chips with an impregnation liquid to cause the cavities within said wood chips to fill with said impregnation liquid, said impregnation liquid including a compound selected from the group consisting of sodium sulphite, sodium hydroxide and sodium hydrogen sulphite, draining said impregnated wood chips, and washing said wood chips with a wash solution whereby said wood chips are prevented from absorbing said wash solution by the presence of a portion of said impregnation liquid remaining within the caviites of said wood chips.

2. The method as set forth in claim 1 wherein the draining of said impregnated wood chips is by selfdrainage.

3. The method as set forth in claim 1 wherein said washing of the wood chips is carried out at atmospheric pressure for up to about two minutes.

4. The method as set forth in claim 1 wherein the wood chips are steamed prior to impregnating the wood chips with said impregnation liquid and wherein the temperature of said impregnation liquid is held below that of the temperature of the wood chips after steaming.

5. The method as set forth in claim 1 wherein the impregnating of the wood chips takes place at atmospheric pressure.

6. The method as set forth in claim 1 wherein the impregnation takes place at an elevated pressure.

7. The method as set forth in claim 1 wherein the chips after washing are further impregnated.

8. A method of treating wood chips in the manufacture of pulp therefrom, comprising the steps of, impregnating said wood chips with a chemical treatment liquid to cause the cavities within said wood chips to fill with said liquid, said chemical treatment liquid adapted for softening said wood chips by actively effecting the fiber walls of said wood chips, draining said impregnated wood chips, and washing said wood chips with a wash solution whereby said wood chips are prevented from absorbing said wash solution by the presence of a portion of said chemical treatment liquid remaining within the cavities of said wood chips.

* * * * *